US007134714B1

(12) United States Patent
Connery

(10) Patent No.: US 7,134,714 B1
(45) Date of Patent: Nov. 14, 2006

(54) HIGHCHAIR HELPER IMPROVEMENTS

(75) Inventor: Mente P. Connery, Orlando, FL (US)

(73) Assignee: Responsible Me, Inc., Orlando, FL (US)

( * ) Notice: Subject to any disclaimer, the term of this patent is extended or adjusted under 35 U.S.C. 154(b) by 0 days.

(21) Appl. No.: 10/299,143

(22) Filed: Nov. 19, 2002

Related U.S. Application Data

(63) Continuation-in-part of application No. 09/653,879, filed on Sep. 1, 2000, now Pat. No. 6,484,989, which is a continuation-in-part of application No. 09/138,889, filed on Aug. 24, 1998, now Pat. No. 6,119,996.

(60) Provisional application No. 60/090,373, filed on Jun. 22, 1998.

(51) Int. Cl.
*A47B 39/00* (2006.01)

(52) U.S. Cl. ..... 297/153; 248/311.2; 297/148; 297/174 R

(58) Field of Classification Search ..... 297/149, 297/153, 130, 344.18, 154, 174, 148, 174 R, 297/145, 172, 188.2, 188.11, 174 CS; 248/311.2, 248/298.1, 918; 108/26, 46
See application file for complete search history.

(56) References Cited

U.S. PATENT DOCUMENTS

| | | | | |
|---|---|---|---|---|
| 1,660,743 | A | 2/1928 | Carroll | |
| 1,786,902 | A | 12/1930 | Doughty, Jr. | |
| 1,937,994 | A | 12/1933 | Taylor | 45/75 |
| 2,210,972 | A * | 8/1940 | Christenson | 211/41.2 |
| D154,271 | S | 6/1949 | Heim | D15/1 |
| 2,707,141 | A | 4/1955 | Wiiter | 311/103 |
| 2,711,872 | A | 6/1955 | Lampke | 248/103 |
| 3,143,374 | A | 8/1964 | Carboni | 297/188 |
| D208,317 | S | 8/1967 | Eroder | D44/110 |
| 3,338,628 | A | 8/1967 | Evans | |
| 3,475,052 | A | 10/1969 | Kaposi | 297/153 |
| 3,516,709 | A * | 6/1970 | Nader | 297/153 |
| 3,829,113 | A | 8/1974 | Epelbaum | 280/30 |
| 3,904,041 | A | 9/1975 | Medgebow | 211/72 |
| 4,105,247 | A * | 8/1978 | Saint | 297/149 |
| 4,165,123 | A | 8/1979 | Hutson | 297/153 |
| 4,261,294 | A | 4/1981 | Bescherer | 119/51 |
| 4,403,786 | A | 9/1983 | Ulics | 280/289 |
| 4,548,440 | A | 10/1985 | Meslin | 297/184 |
| 4,560,128 | A | 12/1985 | Willeby | 248/230 |
| 4,606,576 | A | 8/1986 | Jones | 297/153 |
| 4,765,575 | A | 8/1988 | Bergl | 248/250 |

(Continued)

*Primary Examiner*—Carl D. Friedman
*Assistant Examiner*—Tan Le
(74) *Attorney, Agent, or Firm*—Brian S. Steinberger; Law Office of Brian S. Steinberger, P.A.

(57) ABSTRACT

Detachable bottle and food holding subtrays, clips and support attachments for juvenile chairs such as highchairs, strollers, booster chairs, car seats and activity chairs. The clips can be a snapable C-shape, use a screwable post or a spring biased post for attachment to an existing tray. Removable lids and removable bottle sizing rings can be used. Pre-attached clips can be pre-molded directly to the existing tray. Alternatively, clips can be attached by hook and loop fasteners or peel and stick tape. A drawer type subtray can slide in and out from the existing tray. Alternatively, a pivoting arm can be folded out from the existing tray. The clips, supports, drawers and arms can be used to support and/or hold items such as food out of reach of sitting children, and/or can keep items such as mirrors and toys at selected locations within reach of the sitting child.

5 Claims, 15 Drawing Sheets

U.S. PATENT DOCUMENTS

| | | | | | |
|---|---|---|---|---|---|
| D298,018 | S | | 10/1988 | McMillen | D12/129 |
| 4,795,209 | A | | 1/1989 | Quinlan | 297/153 |
| 4,854,638 | A | | 8/1989 | Marcus et al. | 297/250 |
| 4,858,796 | A | | 8/1989 | Roth | 224/42.44 |
| D303,454 | S | | 9/1989 | Morales | D3/40 |
| 4,927,024 | A | | 5/1990 | Lloyd | 206/562 |
| 4,961,555 | A | | 10/1990 | Egan, Jr. | 248/231 |
| 4,968,092 | A | | 11/1990 | Giambrone | 297/151 |
| 5,092,652 | A | * | 3/1992 | Macaluso | 297/146 |
| 5,106,003 | A | | 4/1992 | Ma | 224/42.42 |
| 5,106,046 | A | | 4/1992 | Rowles | 248/311.2 |
| 5,108,059 | A | | 4/1992 | Curtis | 248/146 |
| 5,114,108 | A | | 5/1992 | Olschansky | 248/311.2 |
| 5,143,335 | A | | 9/1992 | Frankel | 248/215 |
| 5,148,755 | A | | 9/1992 | Morales | 108/47 |
| 5,170,981 | A | | 12/1992 | Lin | 248/311.2 |
| 5,211,607 | A | | 5/1993 | Fermaglish | 472/15 |
| 5,244,175 | A | | 9/1993 | Frankel | 248/215 |
| 5,257,765 | A | | 11/1993 | Halle | 248/222.1 |
| 5,279,452 | A | | 1/1994 | Huynh | 224/42.45 |
| 5,348,374 | A | * | 9/1994 | Kuo | 297/344.18 |
| 5,413,035 | A | | 5/1995 | Fernandez | 108/44 |
| 5,419,265 | A | | 5/1995 | Zimmerman | 108/45 |
| 5,437,439 | A | | 8/1995 | Weisleder | 297/150 |
| 5,458,394 | A | | 10/1995 | Nichols | 297/173 |
| 5,480,211 | A | | 1/1996 | Douglas | 297/174 |
| 5,489,075 | A | | 2/1996 | Ible | 248/104 |
| 5,503,297 | A | | 4/1996 | Frankel | 220/751 |
| 5,586,800 | A | | 12/1996 | Triplett | 297/148 |
| 5,603,479 | A | | 2/1997 | Kristy | 248/548 |
| 5,613,657 | A | | 3/1997 | Olaiz | 248/102 |
| 5,624,095 | A | | 4/1997 | Zissu | 248/231.81 |
| 5,660,432 | A | | 8/1997 | Davis | 297/182 |
| 5,667,119 | A | | 9/1997 | Florence | 224/482 |
| 5,704,576 | A | | 1/1998 | Meeker | 248/214 |
| 5,799,803 | A | | 9/1998 | Muller | 211/90.01 |
| 5,810,432 | A | | 9/1998 | Haut | 297/153 |
| 5,964,501 | A | | 10/1999 | Magnani | 297/174 |
| 5,996,507 | A | | 12/1999 | Joseph | 108/46 |
| 6,056,378 | A | * | 5/2000 | Semon et al. | 312/246 |
| 6,082,537 | A | | 7/2000 | Quinn | 106/371 |
| 6,082,814 | A | | 7/2000 | Celestina et al. | 297/118 |
| 6,095,060 | A | | 8/2000 | Ma | 108/45 |
| 6,119,996 | A | | 9/2000 | Connery | 248/311.2 |
| 6,142,140 | A | | 11/2000 | Shumaker | 126/9 |
| 6,283,042 | B1 | | 9/2001 | Wargo | 108/26 |
| 6,290,063 | B1 | | 9/2001 | Vogt | 206/549 |
| 6,298,793 | B1 | | 10/2001 | Turner | 108/26 |
| 6,334,647 | B1 | | 1/2002 | Khorasi | 297/148 |
| 6,419,312 | B1 | * | 7/2002 | Flannery et al. | 297/149 |
| 6,484,989 | B1 | | 11/2002 | Connery | 248/311.2 |
| 6,497,452 | B1 | * | 12/2002 | Catelli | 297/153 |
| 6,578,496 | B1 | | 6/2003 | Guard et al. | 108/25 |
| D478,219 | S | | 8/2003 | Greger | D6/339 |
| D492,519 | S | | 7/2004 | Nolan | D6/500 |
| 6,932,426 | B1 | | 8/2005 | Greger | 297/149 |
| 7,011,363 | B1 | * | 3/2006 | Connery | 297/153 |
| 2001/0028184 | A1 | | 10/2001 | Sitarski | 297/118 |
| 2003/0197403 | A1 | | 10/2003 | Greger | 297/148 |

* cited by examiner 1000
1100
1110
1120
1125
1130
1135
1140
1142
1144
1145
1146
1150
1154
1155
1156
1158
1160
1170
1172

3230
3200
3125
3123
3120
3000
3100
3220
3210
3205
3135
3130
3305
3315
3310
3140
3145
3143
3330
3320
3300
P2

3210
3215
3205
3135
3305
3315
3310
3320

HIGHCHAIR HELPER IMPROVEMENTS

This invention is a Continuation-In-Part of U.S. patent application Ser. No. 09/653,879 filed Sep. 1, 2000 now U.S. Pat. No. 6,484,989 which is a Continuation-In-Part of U.S. patent application Ser. No. 09/138,889 filed Aug. 24, 1998 now issued as U.S. Pat. No. 6,119,996 on Sep. 19, 2000 which claims the benefit or priority to U.S. Provisional Patent Application Ser. No. 60/090,373 filed Jun. 22, 1998. This invention relates to highchairs, booster chairs, activity chairs, strollers and car seats, and in particular to pre-formed side clips on trays for detachable subtrays, toy accessories, and additional accessories such as mirrors, and for slide-out drawers for holding baby bottles, food and the like, and/or mirrors out of reach of a sitting infant and child, as well as holding toy accessories, and the like that can be located within reach of a sitting infant and child.

BACKGROUND AND PRIOR ART

Feeding a baby can be extremely messy. When using a traditional highchair for feeding, the person feeding the seated infant usually must handfeed the infant holding the jar of food in one hand, while spoon feeding the baby with the other hand. This handholding of the food jar is necessary since the infant has a tendency to reach across the tray width, and knock the objects within their reach. Knocked down jars of baby food can be extremely messy to clean up, as well as resulting in wasted unusable food spilled out from the jar. Additionally, the person feeding the infant must use both of their hands at all times during the feeding process.

Additionally, the feeding of infants also requires a baby bottle filled with milk, juice and the like, to be used. For similar reasons, the baby bottles cannot be temporary stored on the existing tray since the bottles are within easy reach of the infant and can be knocked down creating additional messes and wasted liquids. The problem comes into play when the person feeding the infant must temporarily place the bottle somewhere if they are going to start hand feeding the infant using a handheld food jar, bowl and handheld spoon.

Similar problems occur with other chairs having trays such as infant booster chairs, stroller type chairs, stationary and movable activity chairs, and the like.

To obviate the problems above, the person feeding the infant has had to temporarily place the bottle, food jar, and/or spoon on floor surfaces, adjacent tables and/or countertops. However, this temporary solution creates other problems. In addition to taking up additional space, these surfaces need to be completely clean (bacteria and bug free) to store these objects, and generally require an extra cleanup after the jars, bottles, and spoons have been placed on these surfaces.

Various proposals have been made over the years but fail to solve the problems presented above. U.S. Pat. Des. 208,317 to Broder; U.S. Pat. No. 3,143,374 to Carboni; U.S. Pat. No. 3,465,052 to Kaposi; and U.S. Pat. No. 4,548,440 to Meslin et al. each describe attaching small plate trays to existing highchair trays. However, each of these references requires placing the small plate trays on top of the existing tray putting the small plate trays within easy reach of the infants, and not solving any of the problems presented above.

U.S. Pat. No. 2,711,872 to Lampke describes a telescoping arm with a clamp end for use with baby crib railings. However, Lampke's clamp cannot be used to attach their device over and about the top raised lip edges and bottom of the tray edge on traditional highchair and stroller trays. Furthermore, the arm and clamp mechanism can be potentially harmful to the infant if left unattended.

U.S. Pat. Nos. 1,660,743 to Carroll; 1,937,994 to Taylor; and 2,707,141 to Witter each describe tray attachment devices for attaching to the edges of tables. However, none of these patents has a clamp that allows the device to simultaneously wrap about the top raised lip edge and bottom edge on traditional highchairs and stroller trays. using these devices would create unstable tray attachments. Furthermore, these devices would leave the food jars and bottles at the same height as that of the existing trays themselves. Thus, objects stored on these devices would still be within reach of seated infants.

Other patents of interest that also fail to overcome all the deficiencies to the prior art include U.S. Pat. Des. 303,354 to Morales et al.; U.S. Pat. No. 3,338,628 to Evans; U.S. Pat. No. 3,904,041 to Medgebow; U.S. Pat. No. 4,403,786 to Ulics; U.S. Pat. No. 4,854,638 to Marcus et al.; U.S. Pat. No. 4,858,796 to Roth; U.S. Pat. No. 5,106,046 to Rowles et al.; U.S. Pat. No. 5,148,755 to Morales; U.S. Pat. No. 5,211,607 to Fermaglish et al.; U.S. Pat. No. 5,244,175 to Frankel; U.S. Pat. No. 5,257,765 to Halle; U.S. Pat. No. 5,279,452 to Huynh; and U.S. Pat. No. 5,996,507 to Joseph.

The Morales '454 and '766 patents respectively describe a "food tray for use in vehicles", title and "utility tray for attachment to a wall, or a like", title, and are not for attaching to tray edges on high chairs and the like, and fail to overcome all the problems described above.

SUMMARY OF THE INVENTION

The primary objective of the present invention is to provide a detachable device for attaching to a tray edge of highchairs, booster chairs, activity chairs, strollers and car seats for holding baby bottles, food, and the like, out of reach of a sitting child, in place of using the surfaces of adjacent tables and countertops.

The secondary objective of this invention is to provide a detachable device that can be easily attached and removed to all tray edges on existing highchairs, booster chairs, activity chairs, strollers and car seats.

The third objective of this invention is provide an attachment device for the trays on highchairs, booster chairs, activity chairs, strollers and car seats that reduces the spillage of foods/liquids during infant feeding.

The fourth objective of this invention is to provide an attachment device for the trays on highchairs, booster chairs, activity chairs, strollers and car seats that allows bottles and food jars to be cleanly and safely stored when attached to the tray and when stored off the tray in a refrigerator, and the like.

The fifth objective of this invention is to provide an attachment device for the trays on highchairs, booster chairs, activity chairs, strollers and car seats that can easily be cleaned within a dishwasher, and used within a microwave.

The sixth objective of this invention is to provide an attachment device for trays on highchairs, booster chairs, activity chairs, strollers and car seats that have an adjustable opening for securing different diameter bottles.

The seventh objective of this invention is to provide an attachment device for trays on highchairs, booster chairs, activity chairs, strollers and car seats that have a removable lid for covering food and liquid.

The eighth objective of this invention is to provide an attachment device for trays on highchairs, booster chairs, activity chairs, strollers and car seats that can be separately positioned to a tray surface by removable suction cup type fasteners.

The ninth objective of this invention is to provide built on attachment clips for trays on highchairs, booster chairs, activity chairs, strollers and car seats that can be used to attach and detach subtrays supporting food and/or liquid and/or liquid and/or items such as mirrors out of a child's reach.

The tenth objective of this invention is to provide built on attachment clips for trays on highchairs, booster chairs, activity chairs, strollers and car seats that can be used to attach and detach subtrays entertainment devices such as toys, and the like, within a sitting child's reach.

The eleventh objective of this invention is to provide slide-on drawers for trays on highchairs, booster chairs, activity chairs, strollers and car seats that can be used for supporting food and/or liquid and/or other items such as utensils and mirrors out of a child's reach.

The twelfth objective of this invention is to provide slide-on drawers for trays on highchairs, booster chairs, activity chairs, strollers and car seats that can be used for supporting entertainment devices such as toys and/or other items within reach of a sitting child.

A preferred embodiment of the detachable device includes a clamp having an upper portion for attaching about an upper raised ridge of a tray situated in front of a sitting child, a lower portion for abutting against a lower surface of the tray, and an exterior side having brackets for allowing a bottle holder subtray or a food subtray to be attached thereto. The tray can be part of an existing highchair, a stroller, a booster chair and an activity chair. The upper portion of the clamp can include a planar plate extending over the raised ridge of the tray and a downwardly protruding portion for contacting a surface of the tray inside the raised ridge. The lower portion of the clamp can further include either a screwable post fastener that can abut up against the lower surface of the tray, or a spring biased post fastener.

Another version of the clamp can include a curved flange having a generally C-cross-sectional shape with a channel opening in the flange for wrapping about the raised edge of the tray, a side wall having an upper end connected to the flange, the side wall being adjacent to an exterior surface of the raised edge of the tray, and an upwardly bending flange connected to a lower end of the sidewall, the upwardly bending flange having a portion which abuts against the lower surface of the tray, wherein the clamp means snaps into a lock position about the raised edge and the lower surface of the tray.

A removable shield can be inserted between the bottle/food holder subtrays and the clamps for blocking the sitting child from reaching the food and the liquid. The food subtray can include a substantially flat subtray having raised side edges, and a rear wall perpendicular to the subtray, the rear wall having an upper hook end for attaching to a receiving portion in the exterior wall of the clamp means, the rear wall having a lower end connected to the subtray, wherein the subtray is at a lower level than that of the tray. The bottle holder subtray can include a substantially flat subtray having openings for supporting a baby bottle therein, and a rear wall perpendicular to the subtray, the rear wall having an upper hook end for attaching to a receiving portion in the exterior wall of the clamp means, the rear wall having a lower end connected to the subtray, wherein the subtray is at a lower level than that of the tray. The bottle hold subtray can further include dual cylinders openings for supporting a baby bottle therein, and a real wall perpendicular to the dual cylinders, the rear wall having an upper hook end for attaching to a receiving portion in the exterior wall of the clamp means, the rear wall having a lower end connected to the dual cylinders, wherein the dual cylinders are at a lower level than the tray.

The invention can further use removable lids for covering food dish openings in the subtray, and removable ring type inserts for adjusting the diameter of openings being used to hold glasses, bottles and jars. Furthermore, the invention can use another attachment device such as suction cups which allow the subtrays to adhere on the surface of tables, countertops, and even to the main tray surface itself.

A still another version of the novel invention can include a pre-formed clip molded and/or directly attached to an outer edge of the tray for attaching and detaching the subtray when needed thereon. Additionally, the novel clip can be used to support other items such as mirror thereon. The novel pre-attached clip can also locate the subtray, and/or other item also out of the sitting child's reach. A still another version can have the pre-attached clip on the side of the tray closer to the sitting child so that selected entertainment and play items such as a toy can be located within sitting reach of the child so that the child will be able to play with the supported item on the clip.

A still another version allows for the subtray to slide in and out of a front edge of the main tray in a drawer type manner that also can be used to store food and/or liquids out of reach of the sitting child. A still another version allows for the drawer to pivotally rotate in and out of an outer edge of the main tray for supporting the food and/or liquid out of reach of the sitting child. The out of reach sliding drawer and/or pivoting drawer can also be used to hold and store other items out of reach of the sitting child such as but not limited to utensils, mirrors and the like. A still another version can have the sliding and/or pivoting drawer can be used to specifically support detachable items such as toys within reach of the sitting child so that these items can be used for play and/or for entertaining the sitting child.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figures 1, 2:
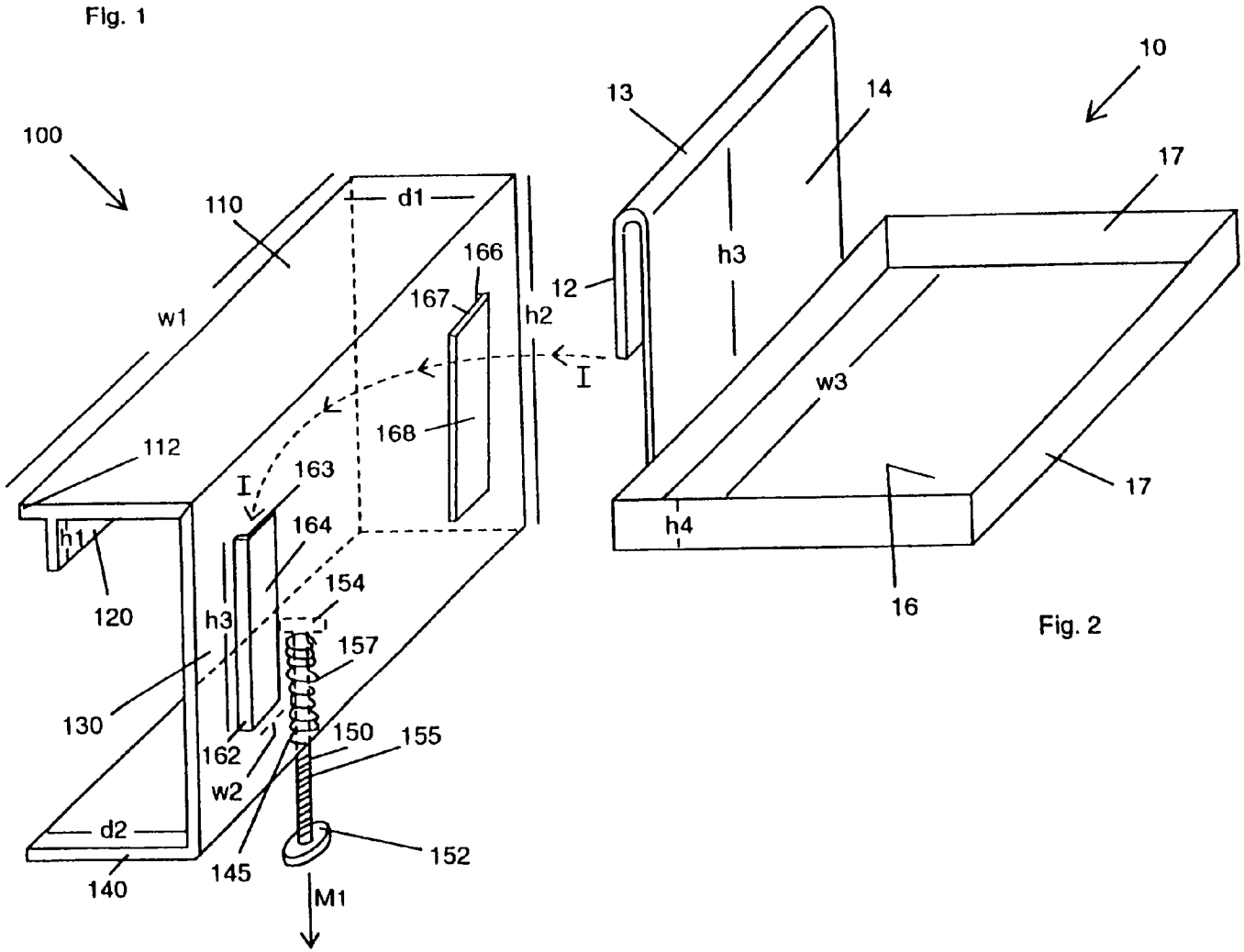
FIG. 1 is a perspective view of a first preferred embodiment of the tray edge adjustable clamp of the subject invention for use with trays on highchairs, booster chairs, activity chairs and strollers.
FIG. 2 is a perspective view of a food subtray attachment for use with the edge clamp of FIG. 1.

FIG. 1 is a perspective view of a first preferred embodiment 100 of the tray edge adjustable clamp of the subject invention for use with trays on highchairs, booster chairs, activity chairs and strollers. Clamp 100 includes an upper planar horizontal plate 110 having a width W1, of approximately 4 and ¼ inches, a depth d1, of approximately 1 and ½ inches. Perpendicular to plate 110 is a downwardly projecting lip 120 has a height h1, of approximately ½ an inch, which is approximately ½ inch inside of upper plate edge 112, grips about an upper raised ridge of tray which is shown in greater detail in later described drawings. Perpendicular to a rear edge of horizontal plate 110 is a vertical plate 130 having a height h2, of approximately 3 inches. On the exterior side of vertical plate 130 are dual L-shaped brackets 162, 164 and 166, 168. Each bracket has vertical side portions 162, 166 having a height h3 of approximately 1 and ½ inches, with inwardly projecting clip walls 164, 166 having a width W2 of approximately 1 inch, and having open channels 163, 167 formed therebetween. Perpendicular to vertical plate 130 is bottom plate 140 (which is parallel to upper plate 110), having a depth d2, of approximately 1 and ½ inches. A post 150 is inserted within a middle portion of bottom plate 140, and has an upper flattened end 154 which can have a expandable spring 157 between flattened end 154 and upper surface of bottom plate 140. On the opposite end of post 152 is a second flattened end 152 which can be moved by the user downward in the direction of arrow M1 so that clamp 100 is fit about tray edges of the highchair, stroller, activity chairs and booster chair which are shown and described in the other figures. Alternatively, post 150 can have threads 155 which allow the post to be screwed through bottom opening 145 within plate 140.

FIG. 2 is a perspective view of a food subtray attachment 10 for use with the edge clamp 100 of FIG. 1. Referring to FIG. 2, subtray 10 includes a hook portion 13 and downwardly protruding end-wall 12 having a substantially C-cross-sectional shape. Attached to hook portion 12-13 is a rear wall 14 having a height h3, of approximately 2 to approximately 3 inches, with a planar plate subtray 16 perpendicularly attached thereto. Plate subtray 16 can have a width W3, of approximately 3 to approximately 5 inches and four vertical sidewalls 17 each having a height h4 of approximately ¼ to ½ of an inch. To use, end-wall 12 is inserted in the direction of arrow 11 into channel openings 163, 167 until the undersurface of hook top 13 abuts against the top edges of clip walls 164, 168. The bottom surface 16 of FIG. 2 can support the bottom of bottles, jars and bowls as well as be able to directly hold food and/or liquids therein.

Figure 3A:
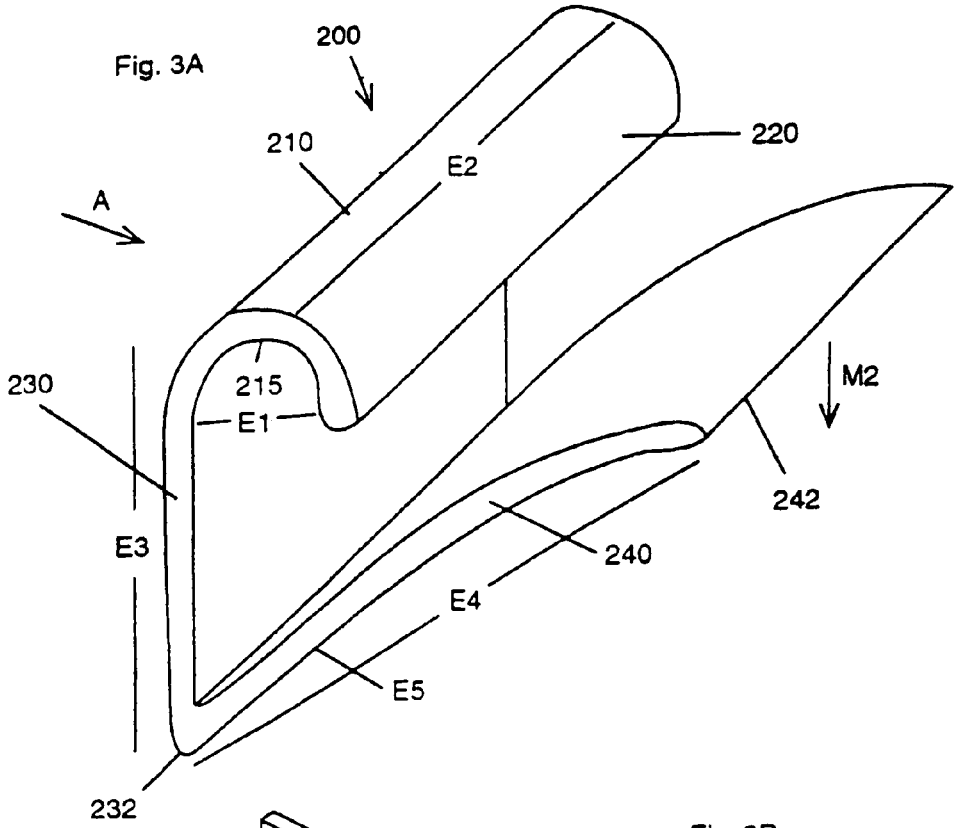
FIG. 3A is a perspective view of a second preferred embodiment of the tray edge expandable clamp of the subject invention for use with trays on highchairs, booster chairs, activity chairs and strollers.

FIG. 3A is a perspective view of a second preferred embodiment 200 of the tray edge expandable clamp of the subject invention for use with trays on highchairs, booster chairs, activity chairs and strollers. Referring to FIG. 3A, expandable clamp 200 includes downwardly curved flange 210 with rounded lip tip 220 attached to a rear wall 230. The diameter E1 between lip 200 and rear wall 230 being approximately 1 inch in diameter. On the exterior side of rear wall 30 are dual clip brackets 262, 265, 268, which correspond to like components in the preceding figures. Small inwardly protruding dimples 261, 269 allow the subtray attachments to have a tighter fit to clamp 200. The width E2 of clamp 200 can be approximately 3 inches and the height E3 of rear wall 230 can be approximately 2 and ⅝ inches, connected to the lower end of rear wall 230 is an upwardly slightly concave bending flange plate 240 having an angle E5 of approximately 1 to 5 degrees, having an end 242 with a height E4, of approximately 1 and ¾ inches above bottom 232. End 242 can be bent down in the direction of arrow M2 when attaching the clamp 200 about the tray edges in the applications to be later describes.

Figure 3B:
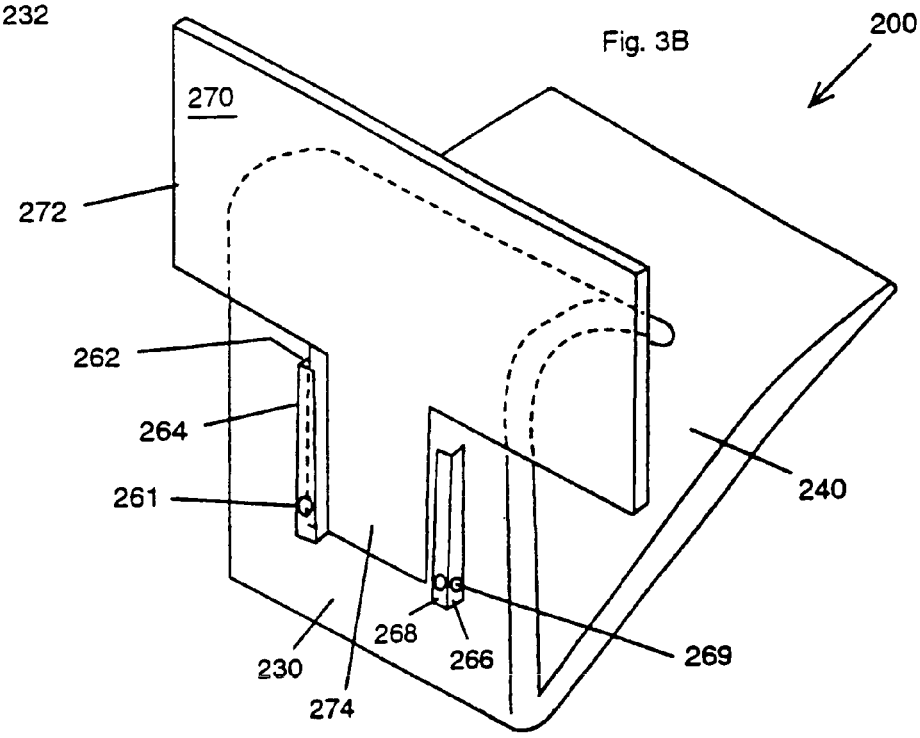
FIG. 3B is a rear view of the expandable clamp of FIG. 3A along arrow A, with a removable shield.

FIG. 3B is a rear view of the expandable clamp 200 of FIG. 3A along arrow A, with a removable shield plate 270 having a general T-shape with a bottom leg 274 that is sized to fit between 264, 268 brackets. In use upper horizontal plate 272 of plate 270 aids as a shield to block a child's access to the contents of the subtrays 10, 20 and 30 described in this invention.

Figure 4:
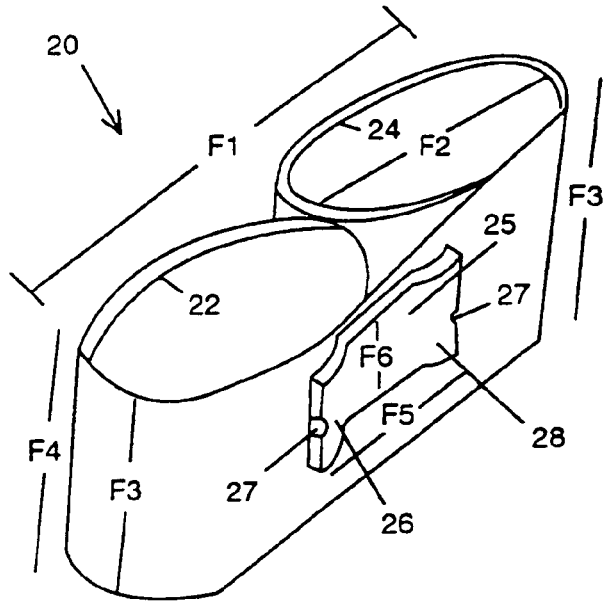
FIG. 4 is a perspective view of a bottle holder subtray attachment with mechanical lock in tab connector for use with the clamps of FIGS. 1 and 3A–3B.

FIG. 4 is a perspective view of a bottle holder subtray attachment 200 with mechanical lock in tab connector 26 for use with the clamps of FIGS. 1 and 3A–3B. Referring to FIG. 4, subtray 200 includes plastic injection molded dual side-by-side cylinders 22, 24 having a width across the front F1 of approximately 2 and ¾ inches. The side and rear heights F3 of dual cylinders 22, 24 can be approximately 2 and ½ inches, while the front height F4 of dual cylinders 22, 24 can be a rectangular tab 25 having slightly angled outwardly bent edges 26, 28 the latter having indented cut-outs 27 therein for locking about dimples 261, 269 of clamp 200 of FIGS. 3A–3B.

Figure 5:
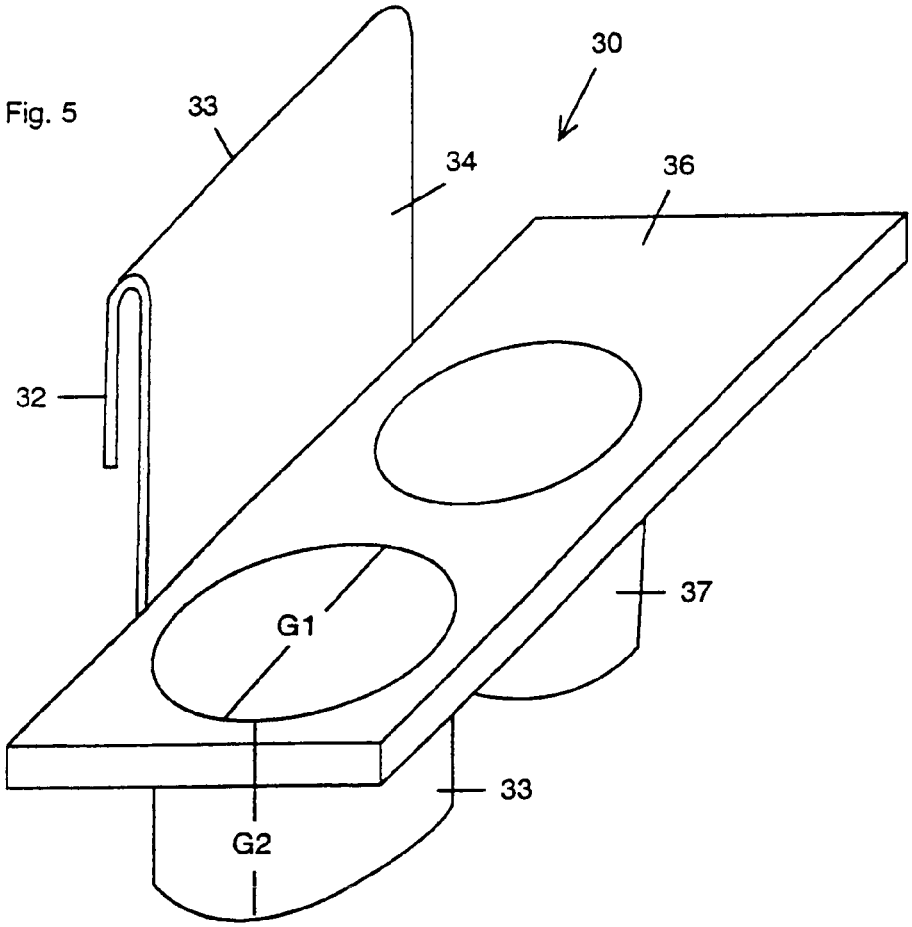
FIG. 5 is a perspective view of another bottle holder subtray attachment with hook tab connector for use with the clamps of FIGS. 1 and 3A–3B.

FIG. 5 is a perspective view of another bottle holder subtray attachment 30 with hook tab connector for use with the clamps of FIGS. 1 and 3A–3B, subtray attachment 30 includes a hook portion 33 and a downwardly protruding end wall 32 having a substantially C-cross-sectional shape. Attached to hook portion 32-33 is a rear wall 34 with a planar plate subtray 36 perpendicularly attached thereto and having dimensions similar to those of FIG. 2. Referring to FIG. 5, plate subtray 36 includes cylinders 33, 37 the later having similar dimensions to cylinders 22, 24 described in reference to FIG. 4. To use end wall 22 of attachment 30 is inserted in the direction of arrow I1 into channel openings 163, 167 shown in FIG. 1 or within brackets 264, 268 shown in FIGS. 3A–3B.

Figure 6:
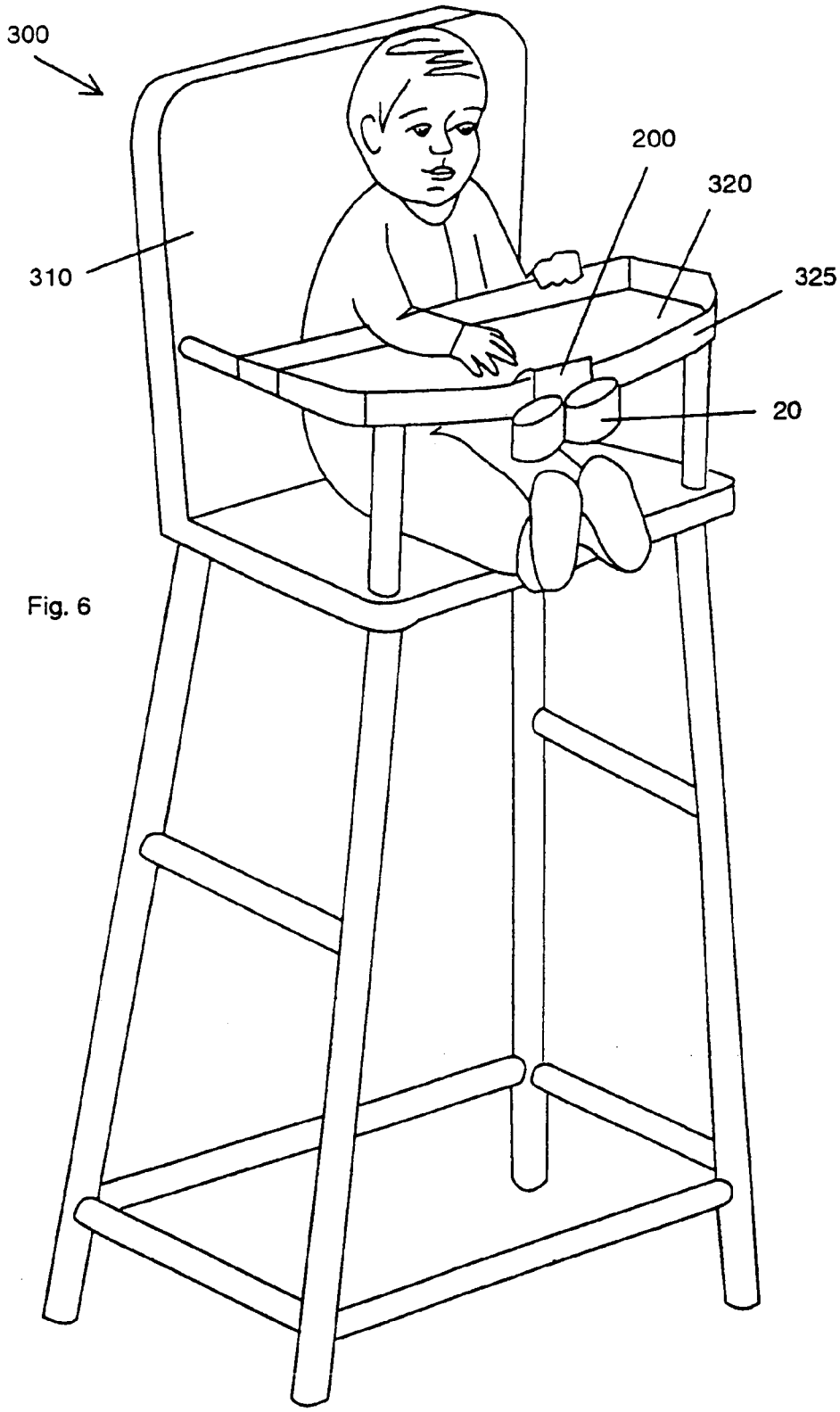
FIG. 6 is a perspective view of the bottle holder subtray attachment of FIG. 4 supported by the clamps of FIGS. 1 and 3 attached to a tray on a highchair.

FIG. 6 shows a perspective view 300 of the bottle holder subtray attachment 20 of FIG. 4 supported by a clamp 200 of FIGS. 1 and 3 pre-attached to a raised edge 325 of a substantially flat surface tray 320 on a highchair 310. The highchair 310 in FIG. 6 clearly showing a chair with a back portion and a seat portion with legs attached beneath the seat portion for raising the seat portion substantially above ground level with the legs expanding outward from the seat portion to the ground level.

Figure 7:
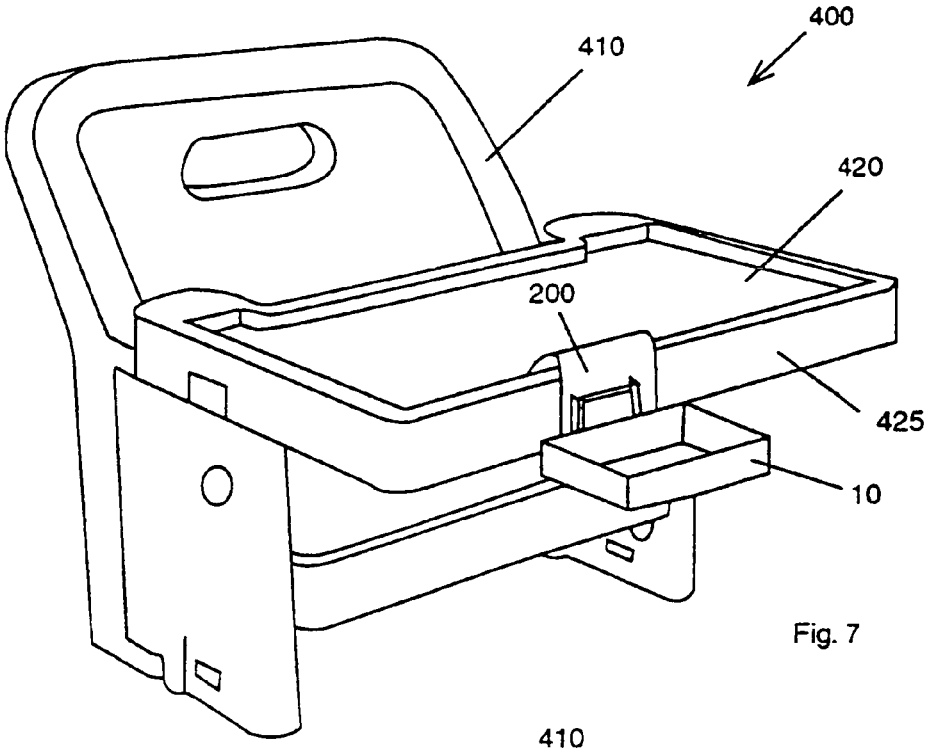
FIG. 7 shows the attachment clamp of FIG. 3A with the food subtray of FIG. 2 attached to a booster chair.

FIG. 7 is a perspective view 400 of the attachment clamp 200 of FIG. 3A with the food subtray 10 of FIG. 2 attached to a raised edge 425 of tray 420 on a booster chair 410.

Figure 8:
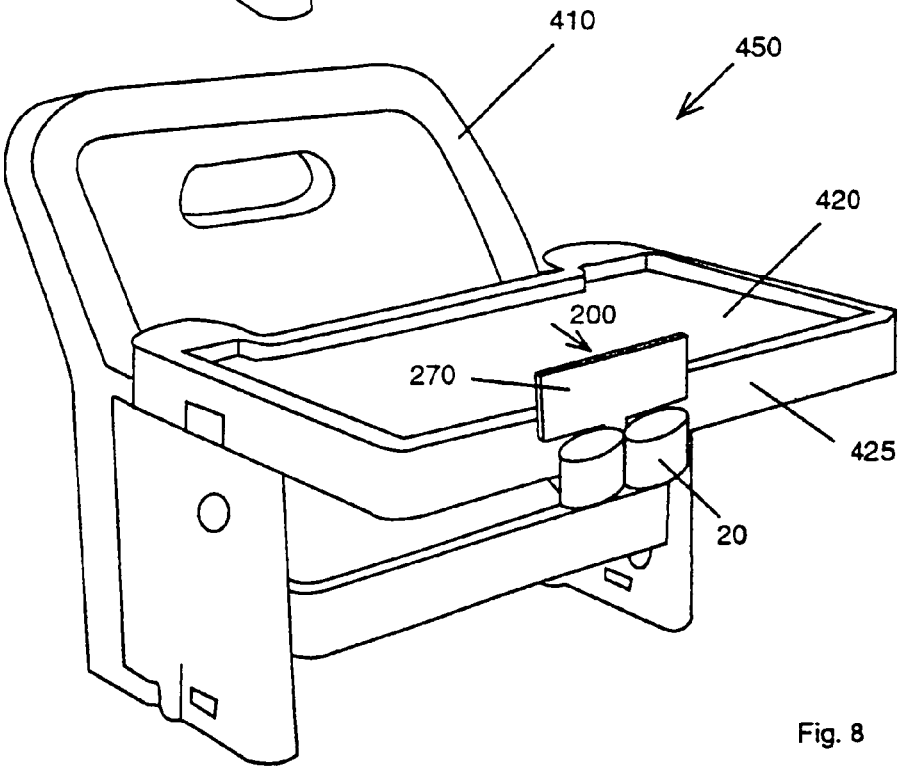
FIG. 8 is a perspective view of the attachment clamp and shield of FIG. 3B with the dual cylinder bottle holder of FIG. 4 attached to a booster chair.

FIG. 8 is a perspective view of 450 of the attachment clamp 200 and shield 270 of FIG. 3B with the dual cylinder bottle holder 20 of FIG. 4 attached to a raised edge 425 of tray 420 on a booster chair 410. Removable shield 270 slides between dual cylinder holder 20 and clamp 200 when used.

Figure 9:
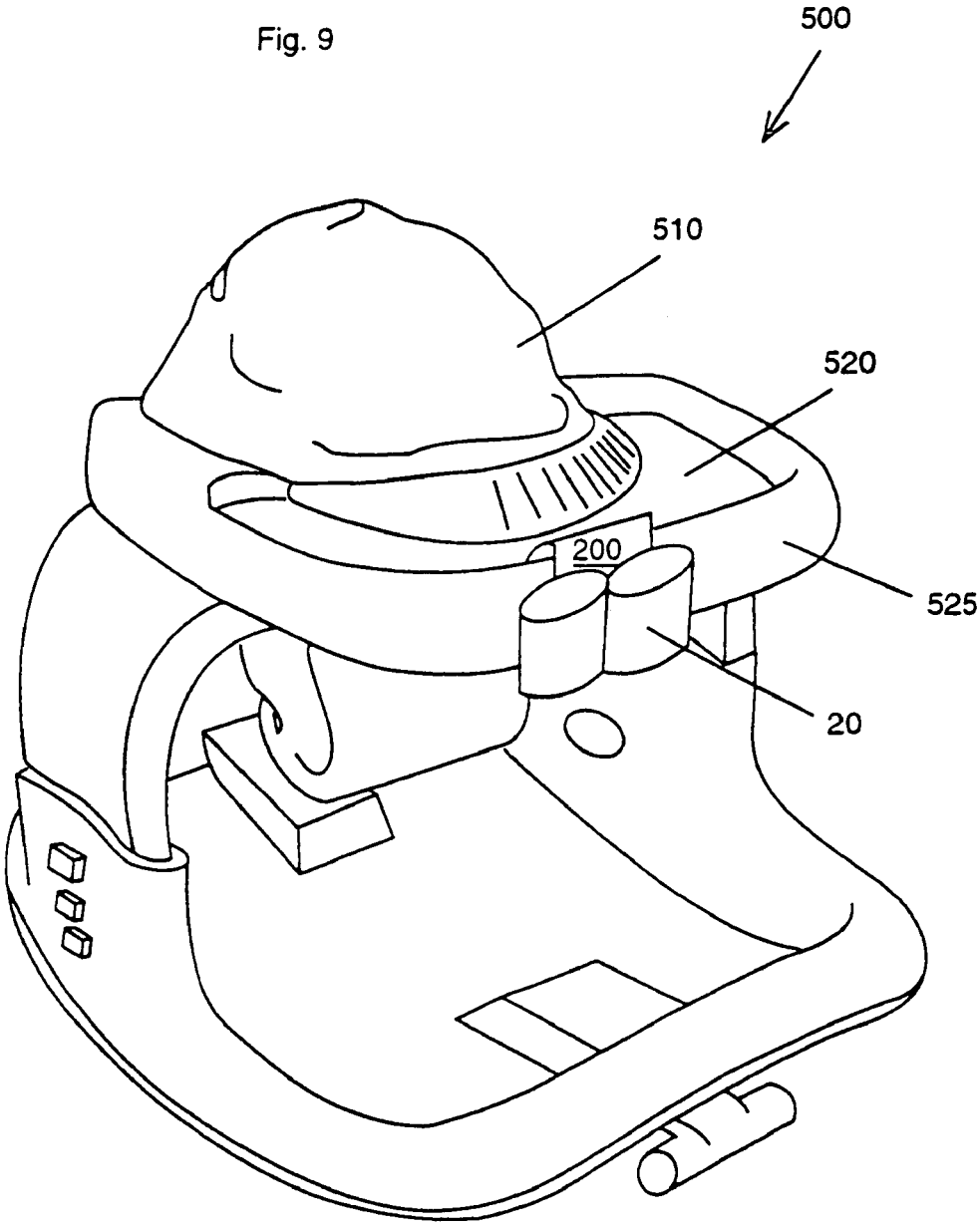
FIG. 9 is a perspective view of the attachment clamp of FIG. 3B with dual cylinder bottle holder of FIG. 4 attached to a stationary activity chair.

FIG. 9 is a perspective view 500 of the attachment clamp 200 of FIG. 3B with dual cylinder bottle holder 20 of FIG. 4 attached to a raised edge 625 of round tray 620 on a moveable activity chair 610.

Figure 10:
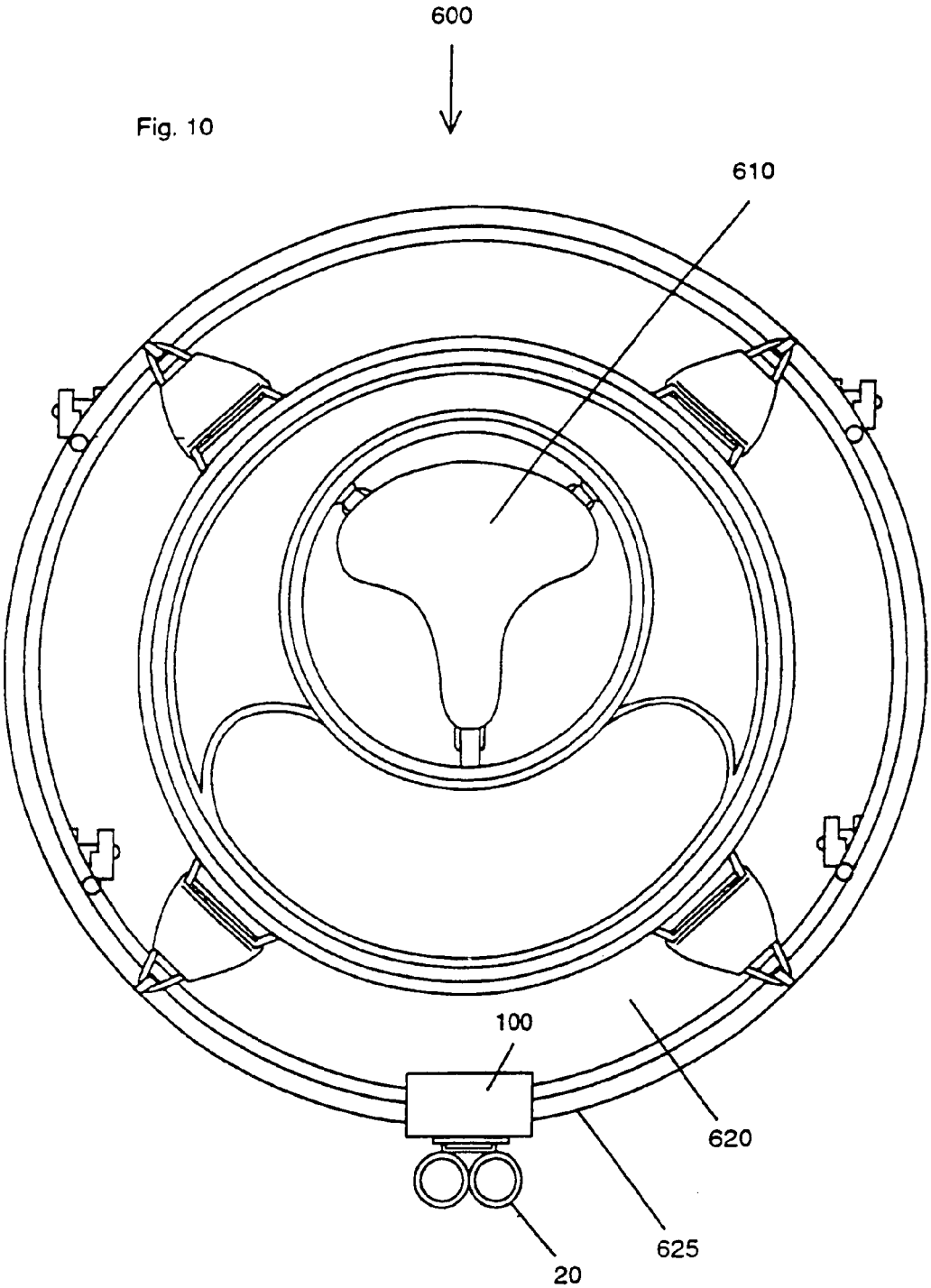
FIG. 10 is a perspective view of the attachment clamp of FIG. 1 with dual cylinder bottle holder of FIG. 4 attached to a movable activity chair.

FIG. 10 is a perspective view 600 of the attachment clamp 100 of FIG. 1 with dual cylinder bottle holder 20 of FIG. 4 attached to a raised edge 625 of round tray 620 on movable activity chair 610.

Figures 11A, 11B:
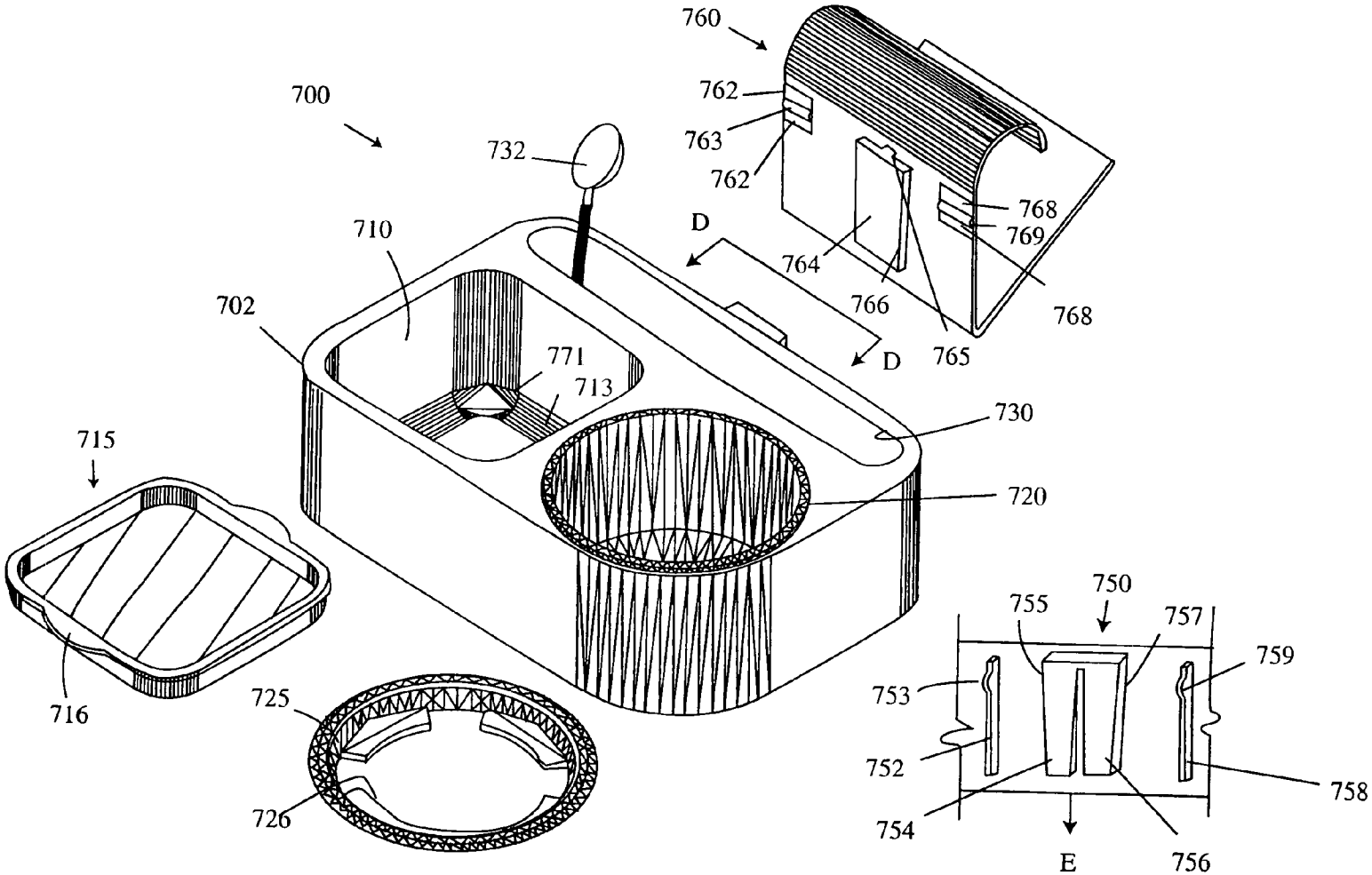
FIG. 11A is a perspective exploded view of another embodiment of the subtray attachment with separate food holder and bottle holder detached from another embodiment of the expandable clamp all detached from a food lid cover and bottle width adjuster.
FIG. 11B is a side view of the subtray attachment of FIG. 11A along arrow D.

FIG. 11A is a perspective exploded view of another embodiment 700 of the subtray attachment holder with separate food holder 710 and bottle holder opening 720 and narrow longitudinal slit 730 along a back of the holder for holding utensils and the like, therein. The holder 700 being attachable and detachable from a clamp 760 similar to those previously described. FIG. 11B is a side view of the backing clip 750 of the holder 700 of FIG. 11A along arrow D.

Referring to FIGS. 11A–11B, holder 700 can be generally rectangular with blunt and/or rounded edges 702 with an opening 710 through the top that can be square shaped with curved interior corners 711 and rounded floor portion 713 for holding food therein. A removable plastic lid 715 can snapably fit over the opening 710 and have portions 716 that can be pushed down to attach the lid and used to be pulled up to remove the lid 715. Another opening 720 in the holder 700 can be circular with or without a floor portion in order to hold liquid type beverages such as a bottle or glass therein. A removable ring 725 made of a resilient plastic material with interior protruding flexible portions can be inserted into the opening 720 to adjust the diameter of the opening to fit different diameter bottles and glasses therein. Along the top of holder 700 can be a slot such as a longitudinal slot having a bottom therein for supporting utensils 732 such as forks and spoons, and the like. Along the backwall of holder 700 are clip connectors 750 that allow the holder 700 to attach and detach from the clamp 760. Clip connectors 750 can include two vertical and raised protrusions 752, 758 each with raised upper bumps 753, 759. In between protrusions 752, 758 can be a raised male tabs 754, 756 with a slot therebetween, each male tab 754, 756 can be attached to the back of holder 700 by edges 755, 757, and each tab 754, 756 can have a wider upper portion that narrow down to a narrower lower portion that allows easy assembly about mateable clip 764–766 on clip 760. On clip 760 raised female tabs 764, 766 are attached to exterior face of clamp 760 by a central member 765 that runs between raised female tabs 764, 766. Additionally, side indentations 762, 768 are on opposite sides of the female clip tabs 764, 766, each with a horizontal raised bump portion 763, 769 thereon. During assembly, holder 700 is positioned so that male clip tabs 754, 756 are positioned above female tabs 764, 766 and moved downward in the direction of arrow E so that male tabs 754 are inserted in the space between female tabs 764, 766 and the face of clamp 760. Simultaneously, bumps 753, 759 on holder 700 snap over respective raised bumps 763, 769 and into indentations 762, 768 respectively snappably locking the holder 700 to the clamp 760.

Figures 12A, 12B:
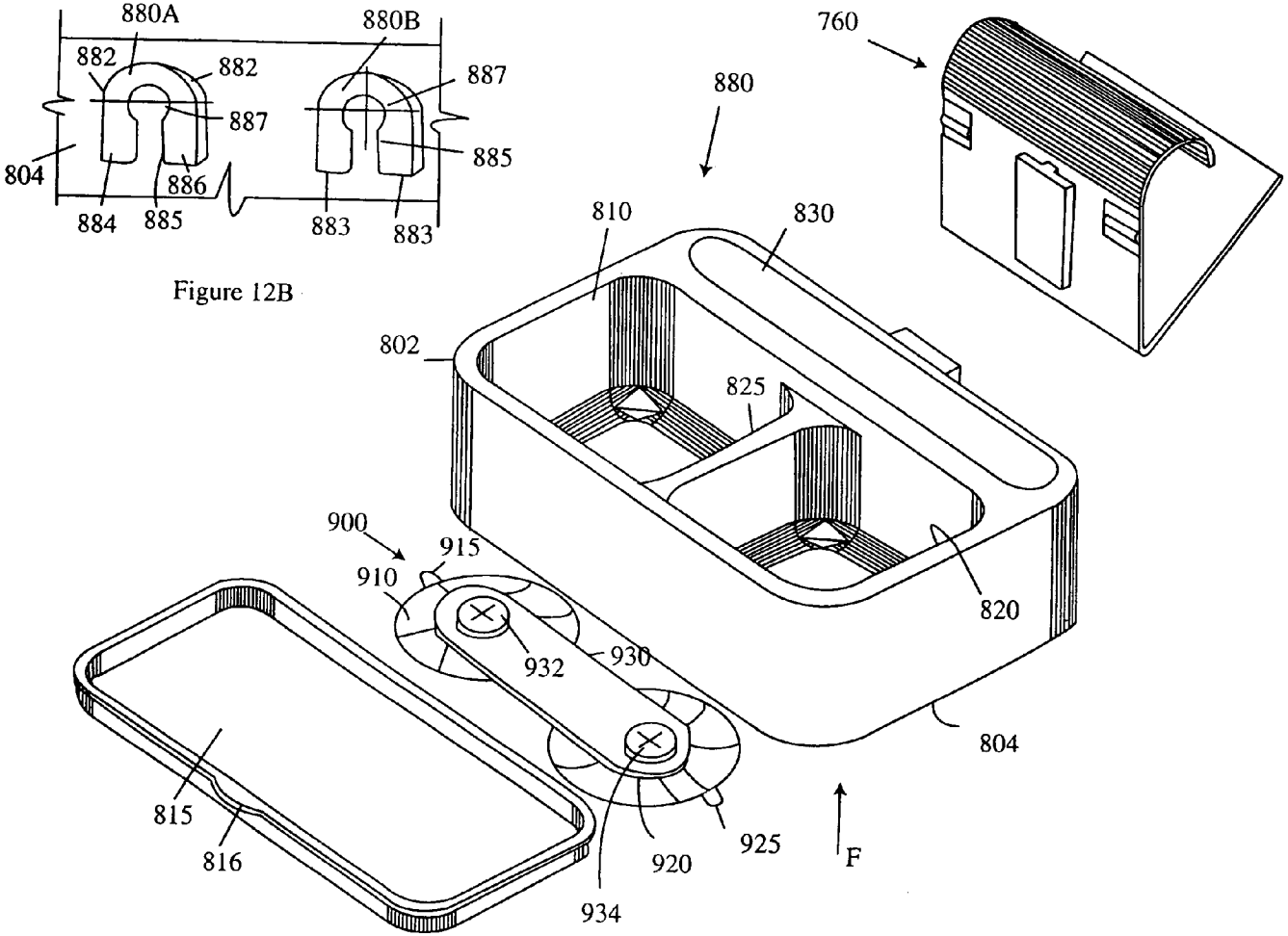
FIG. 12A is a perspective exploded view of another embodiment of the subtray attachment with dual food dishes detached from the expandable clip of FIG. 11A.
FIG. 12B is a bottom view of the subtray attachment of FIG. 12A along arrow F.

FIG. 12A is a perspective exploded view of another embodiment 800 of the subtray attachment with dual food dishes 810, 820 and utensil slot 830 detached from the expandable clip 760 of FIG. 11A. FIG. 12B is a bottom view of the subtray attachment 800 of FIG. 12A along arrow F. Subtray holder 800 can be generally rectangular with blunted and/or curved edges 802 and have utensil slot 830 similar those components in holder 700 previously described. Instead of one food dish, holder 800 can include two or more separated molded food dishes 810, 820 with a separating wall 825 therebetween slightly lower than the depth of each food dish, and one single removable lid 815 having push/pull edge 816 similar to 716 previously described. Lid 815 can be inserted over to snap onto and close off dish openings 810, 820. Underneath holder 800 can be two arc shaped fasteners 880A, 880B each being connected at their outer edges 882, and bottom edge 883 to the undersurface 804 of holder 800, and each having raised tab portions 884, 886 separated from undersurface 804 with a key shaped slot 885 therebetween. A removable fastener 900 can include two pliable type suction cups 910, 920, each having edges 915, 925 that allow the cups 910, 920 to be pulled off a surface that the suction cups are attached to. Each cup 910, 920 can be connected to one another by a pliable plastic member 930 and each cup 910, 920 has a raised central hub portion with flattened head portion 932, 934. Thus, removable fastener 900 can be pressed against any surface such as but not limited to a countertop, the tray surface, and the like, and suction cups 910, 920 pressed down to create a suction hold, followed by the circular opening 887 arc fasteners 880A, 880B being fit about raised flat heads 932, 934 and slid along narrow opening 885 to abut against bottom wall edge 883. The components can be formed such that a tight fit exists when the holder 800 is attached to the flat heads 932, 934 on suction cups 910, 920.

The removable food and bottle holders can also include a plugable drainage hole in the bottom surface. The materials used to make the above described invention can be made from injection molded plastics, ceramic, aluminum, galvanized metal, combinations thereof, and the like, that can be easily detachable and washable within a dishwasher. If made from plastic and ceramic, the components can be useable within microwaves when the heating of food and liquid is needed, and/or used within refrigerators, and freezers.

While the invention has been described having subtray holders and various food dish openings being rectangular, the subtray holders and/or the food dish openings therein can have different shapes such as but not limited to oval, circular, triangular, polygon, and the like.

Although the embodiments describe high chairs and strollers, the invention can be used with all other types of seats having trays such as but not limited to car seats, and the like.

Figures 13, 14:
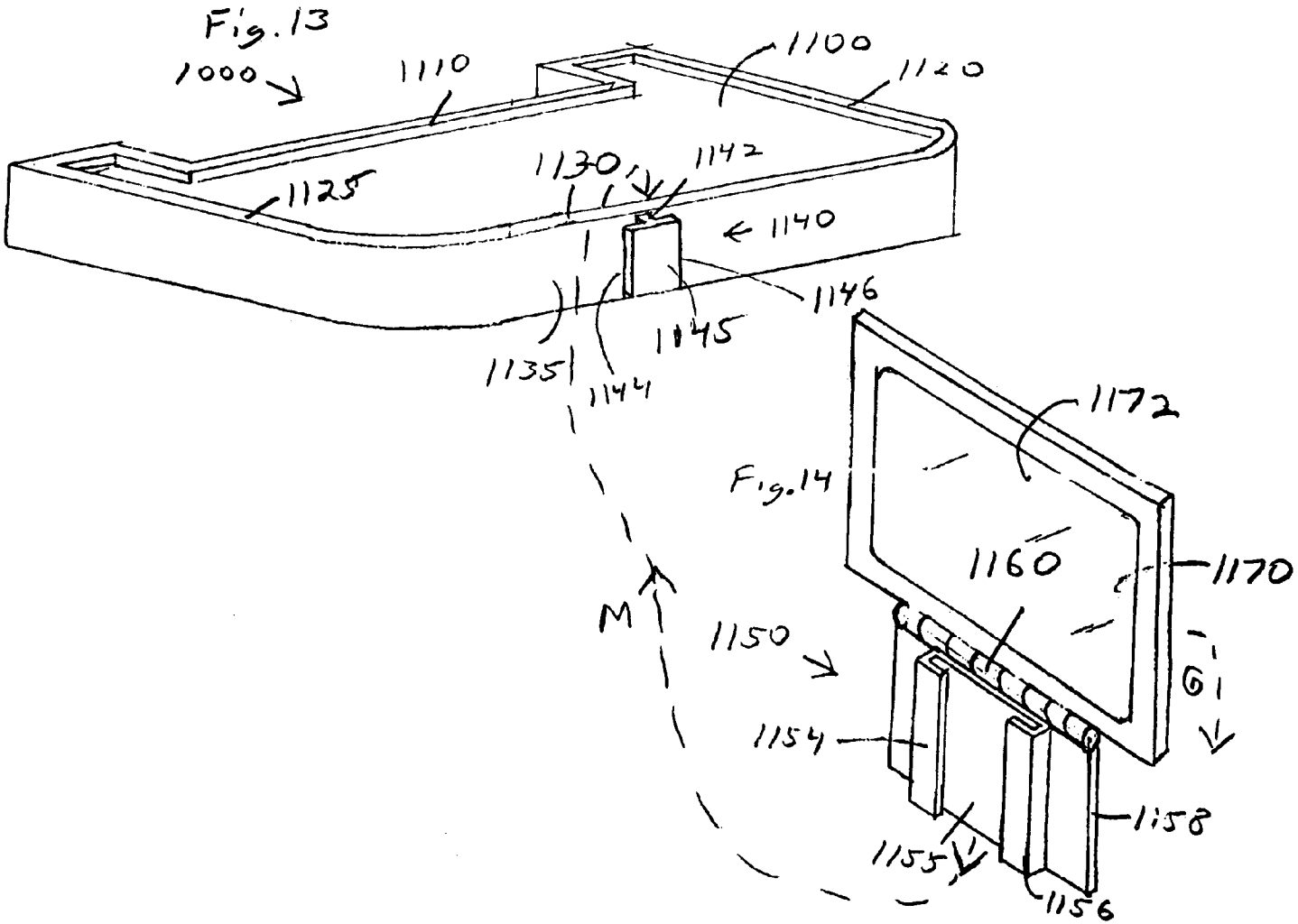
FIG. 13 is a perspective view of another embodiment of a built-on clip attachment for a main tray to juvenile chair.
FIG. 14 is a perspective view of a clipable mirror item that can be used with the clip attachment of FIG. 13.

FIG. 13 is a perspective view of another embodiment 1000 of a built-on clip attachment 1140 for a main tray for a juvenile chair such as those found on highchairs, strollers, and activity chairs described above. This main tray embodiment 1000 can include a main tray surface 1100 having a rear raised perimeter edge 1110 which would be adjacent to a sitting child in a juvenile seat, side raised perimeter edges 1120 and 1125 and an outer raised perimeter edge 1130 opposite to the rear raised perimeter edge 1110. On the outer wall 1135 below the outer raised perimeter edge 1130 can be a built-on clip 1140 that can be pre-molded thereon. Here, the pre-molded clip 1140 can have a T-shape with stem portion 1142 and upper extended side arm wing portions 1144, 1146 extending from a mid-portion 1145.

FIG. 14 is a perspective view of a clipable item 1170 that can be used with the built-on clip attachment 1140 of FIG. 13. Mirror item 1170 can include a mateable second clip 1150 having hook portions 1154 and 1158 which can mateably hook and/or clip about wing portions 1144, 1146 of the built-on clip 1140, and rear wall portion 1155 can abut against outer wall portion 1145 of the built-on clip 1140. A frame portion 1170 can be hingedly attached to the second clip 1150 with a hinge 1160 and can include a reflecting mirror portion 1172 that when the frame portion 1170 is folded vertically upward can allow the sitting child to view themselves. Viewing themselves can add to the amusement of the sitting child. Additionally, the sitting child would be able to view themselves as they are being fed. Folding the frame portion 1170 downward to in the direction of arrow G to a perpendicular configuration to the second clip 1150 can remove the reflecting mirror portion 1172 to be out of view to the sitting child. Additionally, in the folded down position, the frame portion can be horizontal and also be used as a subtray for holding items such as bottles, cups, jars off the main tray surface 1100 out of reach to the sitting child.

Although a male type clip 1140 is shown attached to the tray embodiment 1000, other types of clips such as, but not limited to female configured clips can be used as well.

Figure 15A:
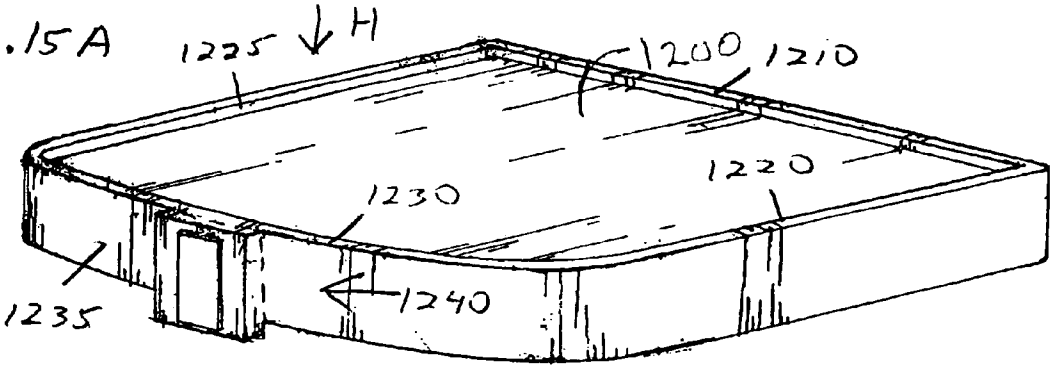
FIG. 15A is a perspective view of another embodiment of a removable fastened on clip attachment for a main tray to a juvenile chair.
Figure 15B:
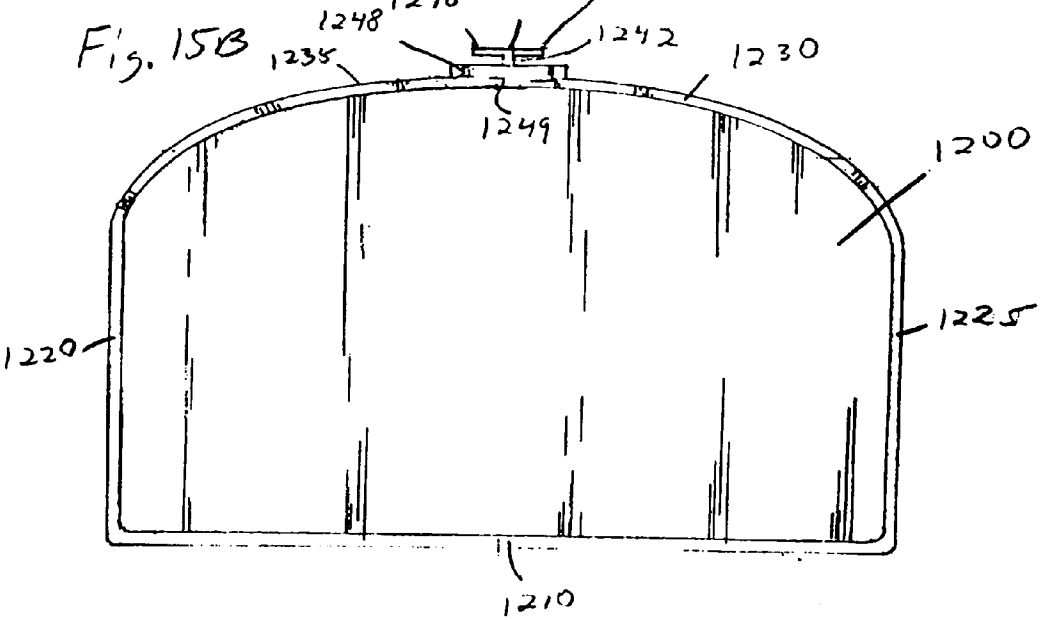
FIG. 15B is a top view of the embodiment of FIG. 15A.

FIG. 15A is a perspective view of another embodiment 1200 of a removable fastened on clip attachment 1240 for a main tray to a juvenile chair such as those found on highchairs, strollers, and activity chairs described above. FIG. 15B is a top view of the embodiment 1200 of FIG. 15A along arrow H. Referring to FIGS. 15A–15B, this embodiment can include a main tray surface 1200 having a rear raised perimeter edge 1210 which would be adjacent to a sitting child in a juvenile seat, side raised perimeter edges 1220 and 1225 and an outer raised perimeter edge 1230 opposite to the rear raised perimeter edge 1210. On the outer wall 1235 below the outer raised perimeter edge 1230 can be a fastened on clip 1240 that can have a mounting wall 1248 that attaches to the outer wall 1235 by removable fastener 1249 such as but not limited to hook and loop fasteners, peel and stick tape, and the like, that would be strong enough to securely support the clip 1240. Clip 1240 can have a T-shape with stem portion 1242 and upper extended side arm wing portions 1244, 1246 extending from a mid-portion 1245.

Figure 16:
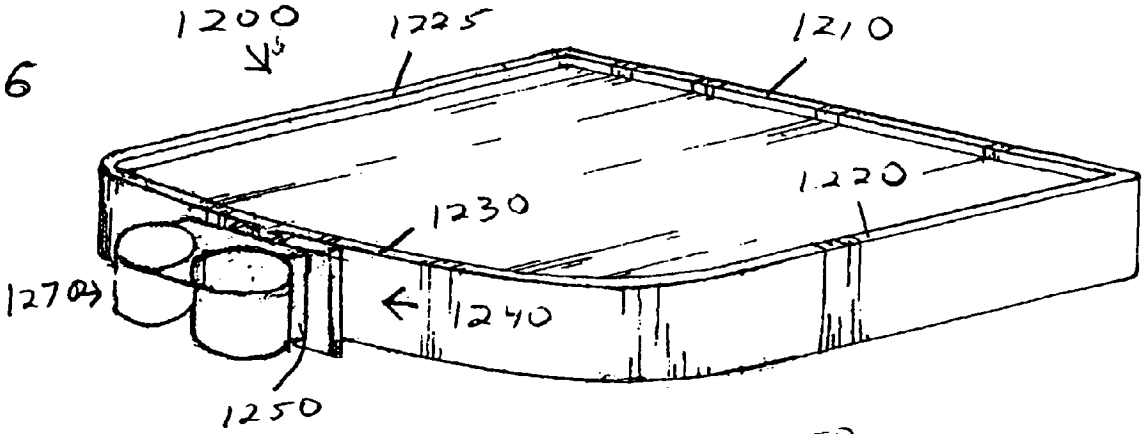
FIG. 16 shows a subtray of the previous embodiments being directly attached to the removable clip attachment of FIGS. 15A–15B.

FIG. 16 shows a subtray 1270 of the previous embodiments being directly attached to the removable clip attachment 1240 of FIGS. 15A–15B. Subtray 1270 can have a rear clip portion 1250 identical to the second clip 1150 of FIG. 14 for allowing the second clip 1250 to mateably attach to the clip attachment 1240 similar to that described in reference to FIGS. 13–14. Subtray 1270 can include holder portions for bottles and jars. Additionally subtray 1270 can include a planar support surface such as those described above.

Figure 17:
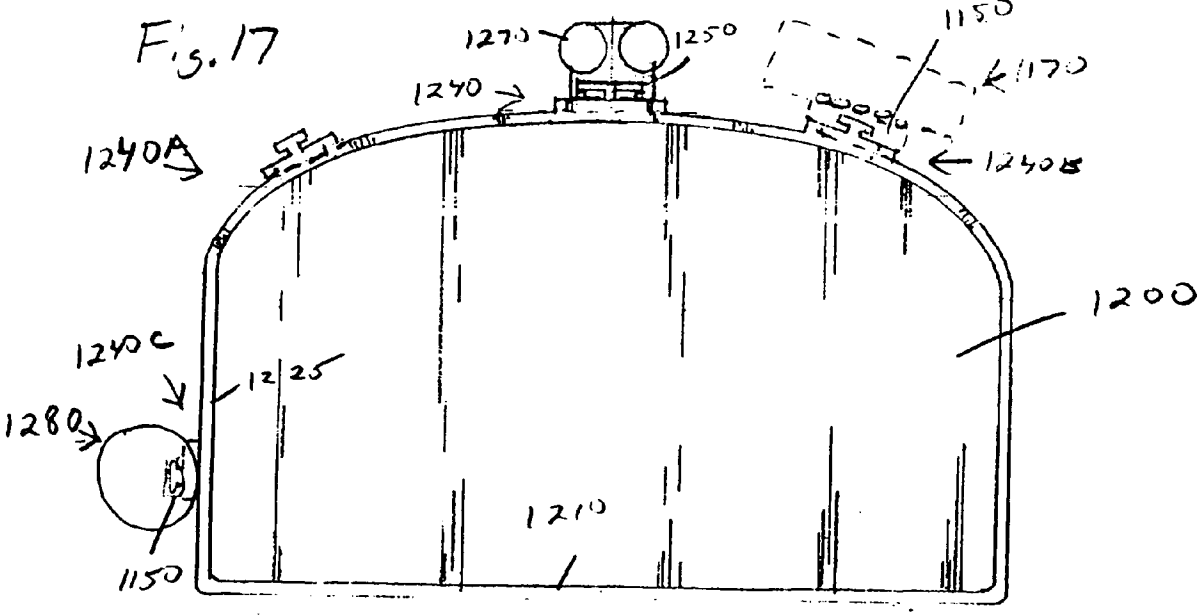
FIG. 17 shows a top view of the removable clip attachments of the preceding figures for supporting a subtray and mirror and toy to the main tray.

FIG. 17 shows a top view of the removable clip attachments 1240, 1240A, 1240B of the preceding figures for supporting a subtray 1270, and mirror 1170 and toy 1280 to the main tray 1200. Clips 1240, 1240A, 1240B can be identical clips. The novel clip attachments 1240 can be positioned along the outer walls of the main tray adjacent to the outer edge 1230 and the side edges 1220, 1225. For example, a toy 1280 can be positioned to be within reach of a child that is sitting adjacent to rear edge 1210. A toy 1280 can include a ball, rattle, and the like, that is attached by a second clip 1150 to the wall attached clip 1240C. Additionally, the built-on clip attachment 1140 of FIG. 13 can be located at additional and/or alternative locations adjacent to the side edges 1120, 1125 for example of the main tray.

Figure 19:
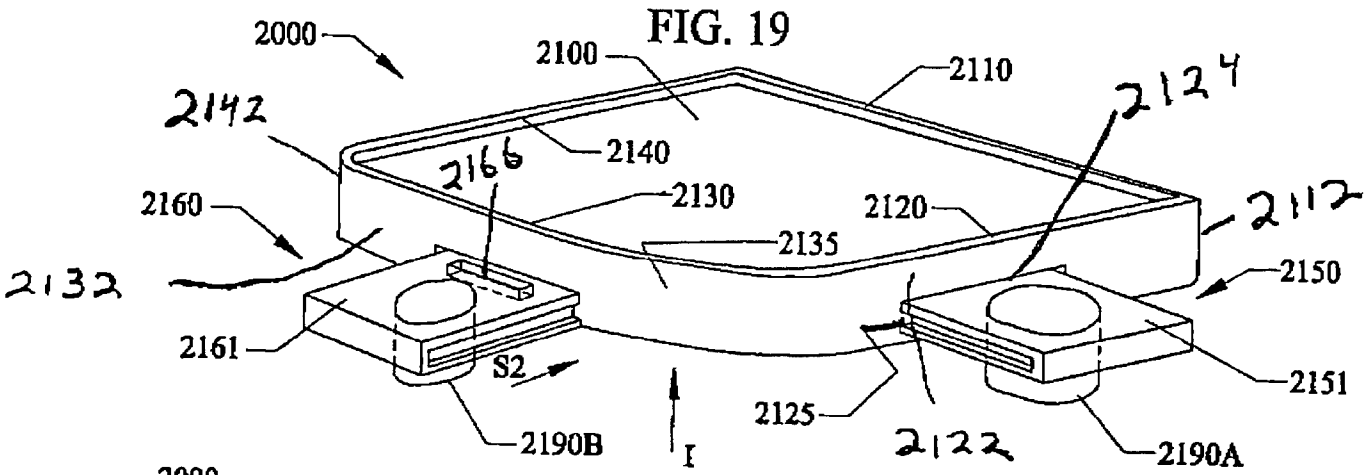
FIG. 19 shows the slidable drawers of FIG. 18 in an extended position holding items off the main tray.
Figure 18:
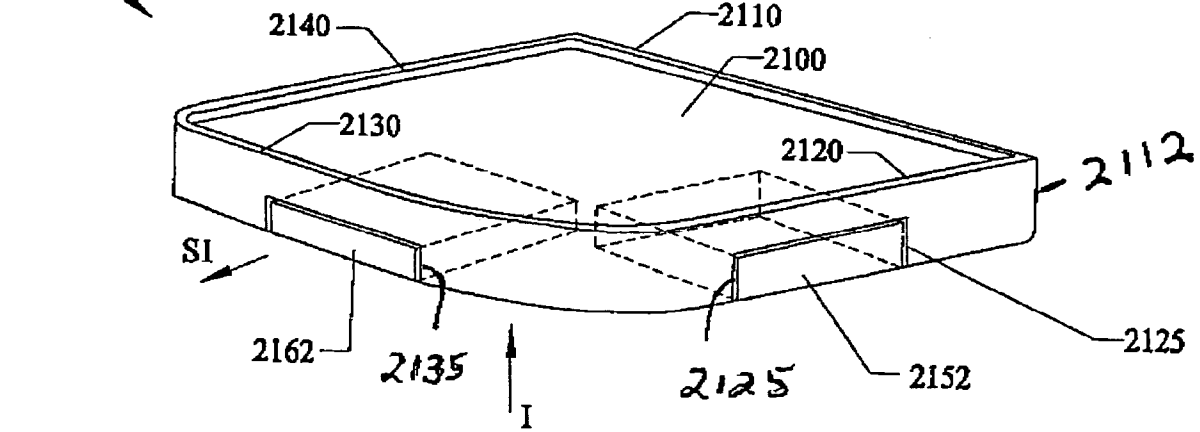
FIG. 18 is a perspective view of a slidable drawer subtray embodiment for a main tray to a juvenile highchair.
Figure 20:
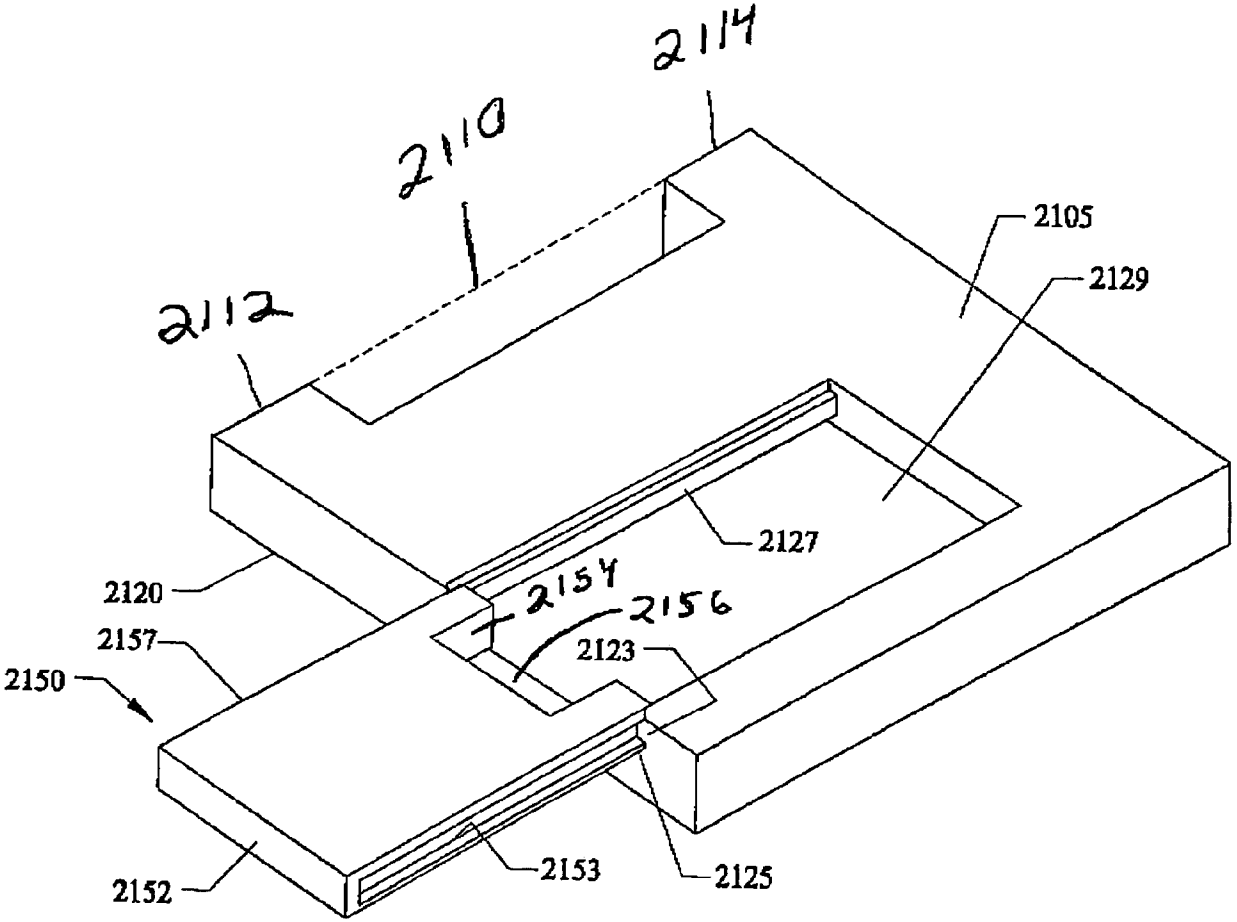
FIG. 20 shows a bottom view of one of the pull out slidable drawers of FIG. 19 along arrow I.

FIG. 18 is a perspective view of a slidable drawer subtray embodiment 2000 for a main tray 2100 to a juvenile chair such as the juvenile highchair shown in FIG. 6. FIG. 19 show the slidable drawers 2150, 2160 of FIG. 18 in an extended position holding items 2190A, 2190B off the main tray 2100, where a stop 2166 can prevent the slidable drawer(s) from being fully pulled out and separated from the main tray 2100. Referring to FIGS. 18–19, this embodiment can include a main tray surface 2100 having a rear raised perimeter edge 2100 on a rear wall 2112 which would be adjacent to a sitting child in a juvenile sent, side raised perimeter edges 2120 and 2140 on side walls 2122, 2142 and an outer raised perimeter edge 2130 on outer wall 2132 opposite to the rear raised perimeter edge 2110. FIG. 20 shows a bottom view of one of the pull out slidable drawers 2150 of FIG. 19 along arrow I with a grip edge 2154 in a raised indentation under the subtray 2150 for the user to grip for pulling the slidable drawer, where a roof portion 2156 can abut against wall lip 2124 and act as a stop to prevent the slidable drawer from being separated out from the main tray. The main tray shown in FIG. 20 can include rear facing corner portions 2112, 2114 such as those shown in FIG. 21 that would extend or wrap above and about the seat of a highchair 310 shown in FIG. 6. Although only one slidable drawer subtray 2150 is shown in detail, the other slidable drawer subtray 2160 would have similar components and similarly function with the main tray.

Referring to FIGS. 18–20, slidable drawer subtray 2150 can be positioned within a slit/recess 2125 in side wall 2122 under side edge 2120 and into a cavity region 2129 in the undersurface 2105 of tray surface 2110. Slidable subtray 2162 can similarly slide within slot/recess 2135 in side wall 2132. Drawer subtray 2150 can be slid out in the direction of arrow S1 to an extended position, and retracted back into the main tray by being moved in the opposite direction S2 where face plate portions 2152, 2162 of the subtrays 2150, 2160 would be flush to the outer wall surfaces 2125, 2135 of the main tray 2000. Grooves 2153, 2157 along the sides of drawer subtray 2150 can slide about internally facing ribs 2125 and 2127 within cavity region 2129 so that the drawer subtray 2150 slides similar to drawers on a track configuration. The upper surfaces 2151, 2161 of the drawer subtrays 2150, 2160 can include planar surfaces and/or holders for holding food items as described in previous embodiments. Like the previous embodiments, these item support holders can be positioned to be out of reach of the sitting child in a highchair 310 shown in FIG. 6. Alternatively, the slidable drawers can be positioned adjacent to the sitting child as well.

Figures 21, 22, 23:
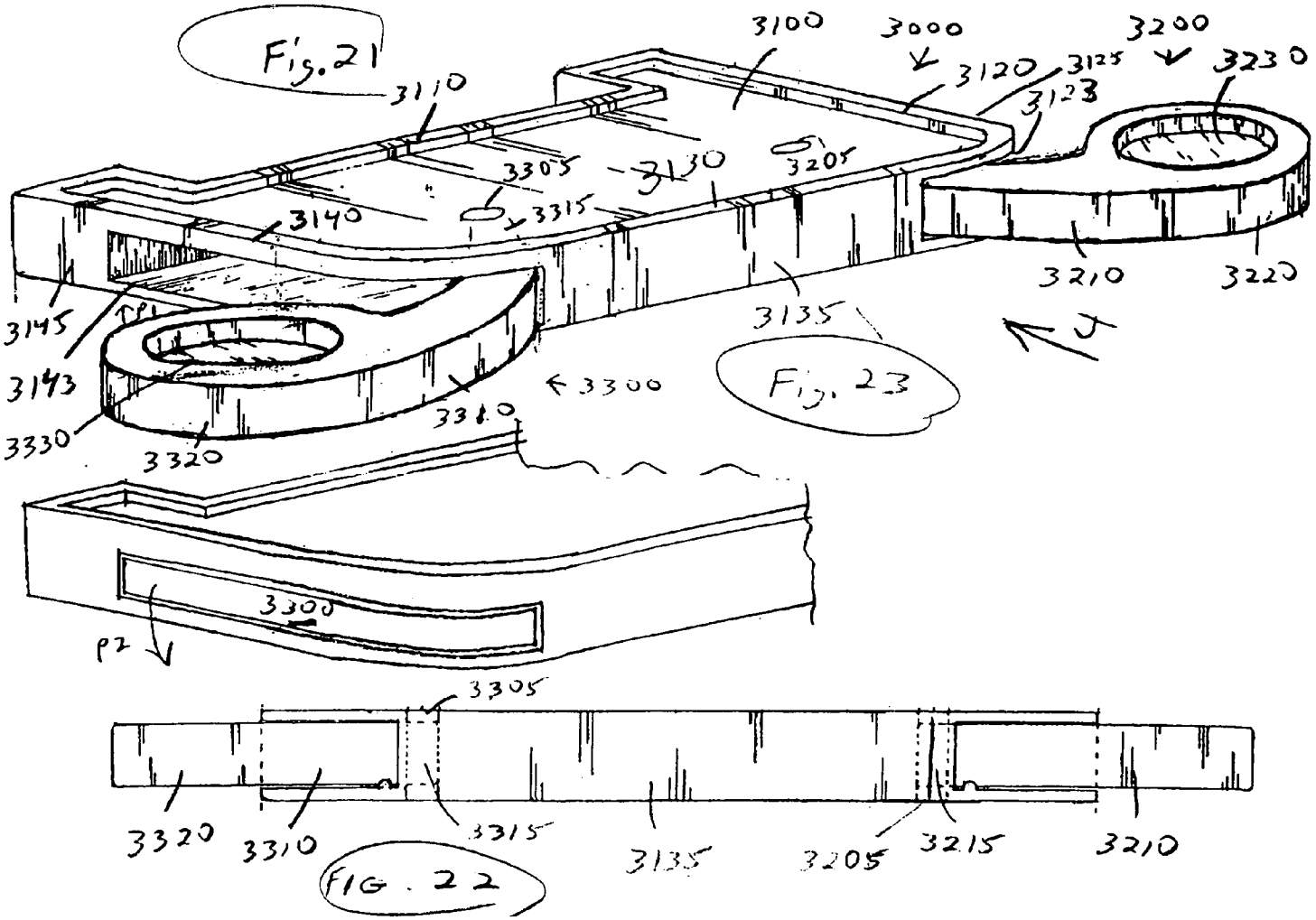
FIG. 21 is a perspective view of a pivotable arm item holder embodiment for a main tray to a juvenile chair.
FIG. 22 is a front view of the embodiment of FIG. 21 along arrow J.
FIG. 23 is another view of the embodiment of FIGS. 21–22 with the arms in a folded position.

FIG. 21 is a perspective view of a pivotable arm item holder embodiment 3000 for a main tray 3100 to a juvenile chair. FIG. 22 is a front view of the embodiment of FIG. 21 along arrow J. FIG. 23 is another view of the embodiment 3000 of FIGS. 21–22 with the arms 3310, 3210 in a folded position.

Referring to FIGS. 21–23, embodiment 3000 can include a main tray surface 3100 having a rear raised perimeter edge 3110 above a rear facing wall with left and right rear facing corner portions that would extend or wrap above and about the seat portion that is adjacent to a sitting child in a highchair 310 shown in FIG. 6. The main tray surface can include side raised perimeter edges 3120, 3140 and an outer raised perimeter edge 3130. Cavity slots 3123, 3143 in side walls 3125, 3145 of tray 3000 allow for arms 3210, 3310 and subtrays 3220, 3320 to stored inside when moved in the direction of arrow P1. Each arm 3210, 3310 can pivot about pin portions 3215, 3315 of the inner ends of the arms which extend within vertical cavities 3205, 3305 of the main tray 3100. The holder portions 3220, 3320 attached to the outer ends of the arms 3210, 3310 can include planer upper surfaces 3230, 3330 for supporting food items as previously described, and can include any of the configurations of the previous embodiments. The arms 3210, 3310 can be initially positioned in folded positions within the main tray 3000 and folded outward when used. The holder portions 3220, 3330 can support items out of reach of the sitting child. Similar to the previous embodiments, the arms can also be positioned to support items such as toys, and the like, within reach of the sitting child.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A juvenile highchair adapted for a sitting child, comprising:

a chair having a back portion and a seat portion, the chair being solely adaptable for seating a sitting small child thereon;

legs attached beneath the seat portion of the chair for raising the seat portion substantially above ground level, the legs expanding outward from below the seat portion;

a main tray attached to a front portion of the chair in front of the sitting child, the tray having a main tray surface with a solid contiguous surface with no through-hole openings therethrough, and a upper raised ridge about a perimeter edge of the tray, and the tray having a rear edge adjacent to the child and outer edge out of reach to the sitting child which is substantially opposite to the rear edge and side edges between the rear edge and the outer edge, the main tray having a outer wall surface beneath the outer edge, the outer wall having a rectangular opening in the outer wall and a recess behind the outer wall, the rectangular opening having a flat contiguous left side edge and a flat contiguous right side edge, the recess having a length and a width and a rear wall;

a slidable drawer-subtray for sliding out along tracks from under the outer edge of the main tray away from the chair, the drawer-subtray having a front end and a rear end with a length therebetween, and the drawer-subtray having a width, the front end of the drawer-subtray having an elongated face plate, the elongated face plate of the drawer-subtray being substantially flush with the outer wall surface of the main tray when the drawer-subtray is in a storage position, the rear end of the drawer-subtray abuting against the rear wall of the recess when the drawer-subtray is in the storage position, the drawer-subtray for supporting an item off of and away from the main tray, the drawer-subtray being continuously attached to the main tray and being moveable from the storage position being underneath the main tray surface of the main tray where the drawer-subtray is not useable for supporting the item, to be moved to an extended position fixed away from the main tray, wherein the item placed on the drawer-subtray in the extended position is located out of reach from the sitting child;

a stop for preventing the drawer-subtray from being separated from the main tray when the drawer-subtray is in the extended position;

a grip edge underneath the drawer-subtray behind the face plate that is solely used for pulling the drawer-subtray from the storage position to the fixed extended position; and a holder surface on the drawer-subtray, for a food item or a beverage item which cannot be spilled by the sitting child, the holder surface being solely used for holding the food item or the beverage item when the drawer-subtray is in the extended position.

2. The juvenile highchair of claim 1, wherein the main tray further comprises:

a rear wall beneath the rear edge of the main tray which is adjacent to the back portion of the chair, the real wall having left and right rear extending corner portions that wrap about and above edge portions of the seat portion of the chair.

3. A juvenile highchair, comprising in combination:

a raised chair having a seat portion adapted for use by a sitting child;

legs attached beneath the seat portion of the chair for raising the seat portion substantially above ground level, the legs expanding outward from below the seat portion;

a main tray attached to a front portion of the chair in front of the seat portion, the tray having a main tray with a solid upper contiguous surface with no through-hole openings formed therethrough for supporting items only above the solid surface, the main tray having an upper raised ridge about a perimeter edge of the main tray, the main tray having a rear edge adjacent to the seat portion and outer edge which is substantially opposite to the rear edge and side edges between the rear edge and the outer edge, the main tray having an outer wall surface with a rectangular opening in the outer wall and a recess behind the outer wall, the rectangular opening having a flat contiguous left side edge and a flat contiguous right side edge, the recess having a length and a width and a rear wall; and a single slidable drawer-subtray having a rear edge, a front edge and a support surface for an item to be supported thereon, the drawer-subtray having a front end and a rear end, the front end having an elongated face plate surface, the drawer-subtray having a length and a width, the elongated face plate surface of the drawer-subtray being substantially flush with the outer wall surface of the main tray when the drawer-subtray is in a storage position, the length and the width of the drawer-subtray allowing for a tight and close fit within the length and the width of the recess when the drawer-subtray is in the storage position, the rear edge of the drawer-subtray abuts against the rear wall of the recess when the drawer-subtray is in the storage position, the drawer-subtray being slidable from the recess in the outer wall surface underneath the outer edge of the main tray, the drawer-subtray being slidable from the storage position directly underneath the solid upper surface of the main tray to an extended fixed position away from the outer edge of the main tray, the rear edge and the support surface of the drawer-subtray being hidden and unuseable and unreachable to support the item while the drawer-subtray is in the storage position, the support surface of the drawer-subtray being visible and useable and reachable to caregivers to the sitting child while attached in the extended position, the drawer-subtray being out of reach of the sitting child while in both the storage position and the extended position;

a holder surface on the single drawer-subtray that only holds the item when the single drawer-subtray is in the extended position, the item being selected from at least one of a food and a beverage; and a stop for preventing the drawer-subtray from being separated from the main tray when the drawer-subtray is in the extended position.

4. A juvenile highchair adaptable for a sitting child, comprising in combination:

a chair having a back portion and a seat portion, the chair being adaptable for seating the sitting small child thereon;

legs attached beneath the seat portion of the chair for raising the seat portion substantially above ground level, the legs expanding outward from underneath the seat portion;

a main tray pre-attached to a front portion of the chair, the main tray having a flat contiguous surface area substantially across an upper surface of the main tray with no through-holes therethrough, the main tray having a raised rear edge portion along an inner edge of the main tray which is adjacent to the back portion of the chair, and an outer raised front edge portion along an outer edge of the main tray away from the chair, the main tray having a front wall below the front raised edge portion, the flat surface area being between the inner raised rear edge portion and the outer raised edge portion;

a rectangular opening recess in the front wall of the main tray with a recess behind the opening, the rectangular opening having a flat contiguous left side edge and a flat contiguous right side edge, the recess having a length and a width and a rear wall;

a slidable sub-tray having an elongated front wall and a rear end opposite to the front wall, the sub-tray being slidable into the recess in the front wall of the main tray by sliding along tracks located on opposite sides of the sub-tray, the elongated front wall of the sub-tray being substantially flush with the front wall of the main tray when the subtray is in a storage position, the rear end of the sub-tray abuting against the rear wall of the recess when the subtray is in the storage position; and a single grip edge underneath the sub-tray behind the front wall, the grip edge for pulling the sub-tray from the storage position to slide out to an extended position away from the chair, wherein the sub-tray in the extended position is adaptable to solely hold food and beverage items out of reach of the sitting child that can be seated in the chair.

5. The juvenile highchair of claim 4, further comprising:

a stop for preventing the slidable sub-tray from being separated from the main tray when the slidable sub-tray is in the extended position.

* * * * *